US005168731A

United States Patent [19]

Vidalis

[11] Patent Number: 5,168,731

[45] Date of Patent: Dec. 8, 1992

[54] CONTINUOUS FOAM DYEING APPARATUS AND METHOD

[75] Inventor: Theodore Vidalis, San Diego, Calif.

[73] Assignees: Laura M. A. Vidalis; Serge E. Vidalis, both of Orleans, Canada

[21] Appl. No.: 685,604

[22] Filed: Apr. 15, 1991

[51] Int. Cl.[5] ..... D06B 1/08

[52] U.S. Cl. ..... 68/200

[58] Field of Search ..... 68/200, 205 R, 158, 68/181 R; 118/410, 411

[56] References Cited

U.S. PATENT DOCUMENTS

| | | | |
|---|---|---|---|
| 1,794,039 | 2/1931 | Silvano et al. | 68/200 X |
| 2,817,227 | 12/1957 | Eriksson | 68/205 R X |
| 3,763,672 | 10/1973 | Bahnsen | 68/205 R |
| 4,305,169 | 12/1981 | Vidalis | 68/200 X |
| 4,612,874 | 9/1986 | Mitter | 68/200 X |
| 4,938,038 | 7/1990 | Sbaschnigg et al. | 68/158 X |

FOREIGN PATENT DOCUMENTS

| | | | |
|---|---|---|---|
| 2359276 | 6/1975 | Fed. Rep. of Germany | 68/200 |
| 2504701 | 8/1975 | Fed. Rep. of Germany | 118/411 |

*Primary Examiner*—Philip R. Coe
*Attorney, Agent, or Firm*—Rodney F. Brown

[57] ABSTRACT

An apparatus and method are provided for generating a foam from a preheated dye solution and subsequently applying the foam to continuous strands of yarn wherein the foam is driven by a pressure differential. The apparatus has a foaming pan for producing the foam from the dye solution and a gas. The pan opens into a foam transmission chamber at or near ambient pressure which fluid communicates with an evacuated spent foam discharge chamber across an open interface. The yarn is dyed by conveying it through the open interface and contacting it with the foam which is drawn across the open interface in a flow path perpendicular to the yarn by the pressure differential between the foam transmission and discharge chambers.

12 Claims, 4 Drawing Sheets

CONTINUOUS FOAM DYEING APPARATUS AND METHOD

FIELD OF THE INVENTION

The present invention relates generally to dyeing yarn. More particularly, the present invention relates to an apparatus and method for continuously dyeing yarn. The present invention particularly, though not exclusively, relates to an apparatus and method for continuously dyeing yarn by applying a dye foam to the yarn wherein the foam is driven by a pressure differential.

BACKGROUND OF THE INVENTION

Traditional methods of yarn production involve a number of segmented batch processes including reeling, dyeing, extraction, drying and winding of the yarn. Batchwise processing in general is extremely labor intensive, accounting for a disproportionate share of production costs as labor costs tend to be relatively high in comparison to other production costs. Batch dyeing of yarn in particular is a disproportionately costly process because compounding the problem of high labor costs are other inherent high cost disadvantages unique to the batch dyeing process.

In the batch dyeing process, a dye bath solution is prepared and a skein of yarn is immersed in the solution until the yarn becomes impregnated with the dyestuff. The skein is then removed from the solution and the spent solution is disposed. This process consumes a tremendous amount of energy and water, the cost of which, like labor, is relatively high in comparison to other production costs. For example, more than 85% of the total energy used in the production of yarn is consumed during the dyeing process.

As such a dyeing process is needed which cost effectively reduces energy and water consumption as well as labor intensity. This need is driven not only by the desire to cut costs, but by the increasing restrictiveness of environmental regulations as applied to manufacturing industries. The reduction of water and energy consumption reduces the environmental impact of the process by reducing the volume of waste effluent produced thereby. Accordingly, it is particularly desirable to develop a more environmentally compatible yarn dyeing process which has significantly lower energy, water and labor requirements than dyeing processes presently known in the art.

SUMMARY OF THE INVENTION

The present invention is an apparatus and method for continuously generating a foam from a dye solution and continuously dyeing yarn with the resulting foam. The apparatus comprises a foaming pan containing the dye solution and a heater in heat transfer communication with the pan to heat the dye solution. A gas distributor is submerged in the heated solution. The top of the pan is open and continuous with a foam transmission chamber. The foam transmission chamber tapers to an outlet port which aligns opposite a correspondingly sized inlet port of a foam discharge chamber. The outlet and inlet ports of the foam transmission and discharge chambers respectively are in fluid communication with one another across an open interface which contains the foam flux plane. A pump is connected to the foam discharge chamber to create at least a partial vacuum in the discharge chamber while the pressure in the foam transmission chamber is at a reference pressure greater than the foam discharge chamber. The reference pressure is typically at or somewhat above ambient atmospheric pressure.

In a first embodiment of the present invention, the apparatus is adapted to dye continuous strands of coiled yarn. Accordingly, a yarn coiler is provided which preliminarily coils the continuous strands of yarn in preparation for dyeing. A pair of opposingly mounted porous belts are provided to receive the coiled yarn strands from the coiler and convey the strands through the interface in a direction substantially perpendicular to the foam flow direction. The belts are continuous screens, each connected to a drive which rotates the belts in opposite directions. The belts parallelly pass through the interface, abutting one another to hold the coiled yarn strands therebetween and ensure uniform contacting of the yarn with the foam.

In a second embodiment of the invention, the apparatus is adapted to dye continuous strands of substantially straight, i.e., uncoiled, yarn. Accordingly, a straight yarn guide is provided which likewise conveys the continuous strands of straight yarn through the open interface in a direction substantially perpendicular to the foam flow direction. The guide includes guide rollers and a stationary frame positioned in the interface to maintain alignment of the yarn therein. The frame has open windows formed through it which enable the foam to contact the yarn as the foam passes across the interface. The guide rollers redirect the yarn up and down through the frame for a plurality of dye applications in the interface to ensure uniform contact between the yarn and foam.

The invention has been described above with reference to one foam transmission chamber and one foam discharge chamber aligned across an open interface to form a single coupling. However, the apparatus is further operative in series with a plurality of such couplings. Each coupling is in fluid isolation from the other couplings by means of a plurality of partitions positioned in the interface so that foam from one coupling does not commingle with foam from another coupling. The couplings can be stacked in an alternating sequence so that the foam is applied to the yarn from alternate directions as the yarn passes through the interface.

In operation, a dye foam is continuously generated by bubbling gas from the distributor through a heated dye solution in the pan which further contains a surfactant to promote foam formation. The foam is drawn from the transmission chamber across the interface to the discharge chamber by the pressure differential between the transmission and discharge chambers while the tapering of the transmission chamber enhances the quality of the foam. The yarn is simultaneously conveyed either in a coiled or a straight condition through the interface in the manner described above and the yarn is contacted therein with the foam. The dyestuff contained in the foam is deposited on the yarn and the spent foam is discharged via the foam discharge chamber.

A number of practical advantages are realized by the apparatus and method of the present invention. Multiple applications of the foam from a plurality of couplings provides uniform dyeing of the yarn. Heating of the foam to a predetermined elevated dyeing temperature maintains the foam at a constant viscosity and fixes a significant fraction of the dyestuff to the yarn on contact, thereby reducing the downstream steaming load. Maintaining the pressure differential between the foam transmission and discharge chambers increases foam generation capacity by eliminating backpressure on the pan and enhances penetration of the dyestuff into the yarn as well as uniformity of application.

The novel features of this invention, as well as the invention itself, both as to its structure and its operation, will be best understood from the accompanying drawings, taken in conjunction with the accompanying description, in which similar reference characters refer to similar parts, and in which:

DESCRIPTION OF PREFERRED EMBODIMENTS

Figure 1:
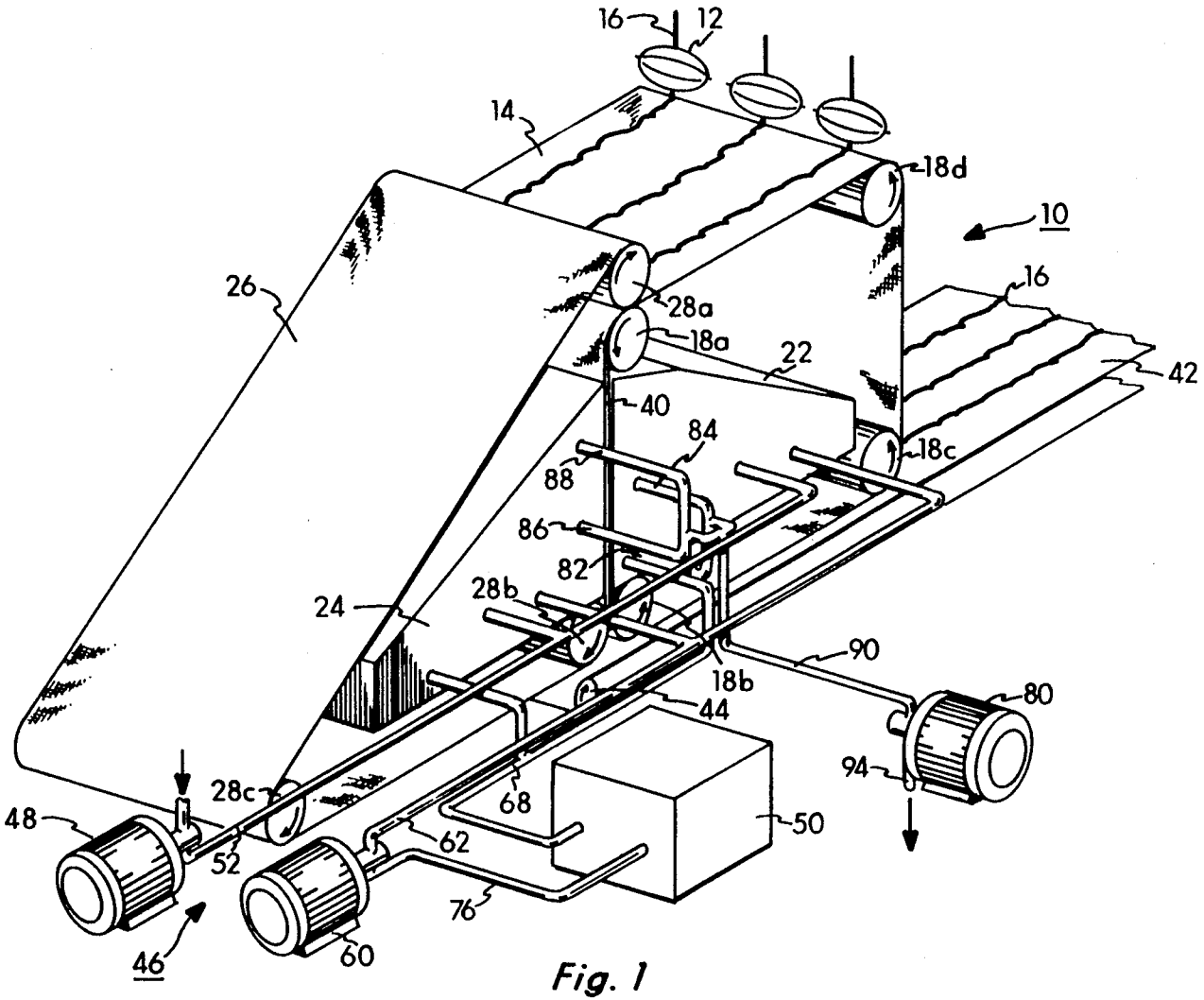
FIG. 1 is a perspective view of the dyeing apparatus of the present invention.

Referring initially to FIG. 1, an embodiment of the yarn dyeing apparatus of the present invention is shown and generally designated as 10. The yarn feed to apparatus 10 is provided by a plurality of coilers, each receiving a single strand of yarn from a source not shown. Representative of coilers is 12 which is positioned above feeder belt 14 to receive yarn strand 16 in a straight condition from the yarn source and discharge yarn strand 16 in a coiled condition onto feeder belt 14. Feeder belt 14 is continuous porous surface engaged by rollers 18*a*, 18*b*, 18*c*, 18*d* which are at least as wide as belt 14 and which are positioned to define a substantially rectangular pathway surrounding a first dye unit 22. Rollers 18*a*, 18*b*, 18*c*, 18*d* drive belt 14 in a counterclockwise rotation around first dye unit 22 as designated by the arrows shown on the rollers.

A second dye unit 24 is positioned opposite first dye unit 22 and is surrounded by a stabilizer belt 26 which is a continuous porous surface fabricated from the same or similar material as feeder belt 14. Stabilizer belt 26 is the same width as feeder belt 14 and is engaged by rollers 28*a*, 28*b*, 28*c* which are at least as wide as belt 26 and which are positioned to define a substantially triangular pathway surrounding second dye unit 22. Rollers 28*a*, 28*b*, 28*c* drive belt 26 in a clockwise rotation around second dye unit 24 as designated by the arrows shown on the rollers.

As is shown in FIG. 1, roller 28*a* is positioned atop roller 18*a* and feeder belt 14 and stabilizer belt 26 are pinched between rollers 18*a* and 28*b*. Roller 28*b* is positioned laterally opposite roller 18*b* such that feeder belt 14 and stabilizer belt 26 are pinched between rollers 18*b* and 28*b*. In response to the positioning of rollers 18*a*, 18*b*, 28*a*, 28*b*, a vertical pathway 36 for belts 14, 26 is defined which extends from rollers 18*a*, 18*a* to rollers 18*b*, 28*b*. Accordingly, belts 14, 26 move parallelly downward on vertical pathway 36 through an open interface 40 formed between first and second dye units 22 and 24 while in abutting relation to one another.

A yarn discharge belt 42 is shown in part which is provided beneath rollers 18*b*, 28*b* and enables removal of dyed yarn strand 16 from dyeing apparatus. Belt 42 is continuous and engages roller 44 to rotate belt 42 away from apparatus 10 for delivery of dyed yarn strand 16 to other downstream processing units not shown such as steamers, dryers and winders.

Dyeing apparatus 10 further includes a fluids circulation system generally designated as 46 for foam generation in cooperation with first and second dye units 22 and 24 as well as for spent foam withdrawal therefrom. System 46 comprises a gas pump 48, a liquid storage tank 50, and a gas distribution line 52 exiting pump 48. Gas distribution line 52 branches to enter first and second dye units 22, 24 respectively. Pump 48 which draws from a gas source not shown.

System 46 further comprises a liquids recirculation pump 60. Liquids feed line 62 connected to pump 60 distributes liquids to first and second dye units 22, 24 and liquids withdrawal line 68 removes liquids from first and second dye units 22, 24. Liquids withdrawal line 68 discharges liquids from first and second units 22, 24 to tank 50 where the liquids are circulated back to pump 60 via tank outlet line 76.

Foam withdrawal and pressure maintenance is provided by vacuum pump 80 in fluid communication with first and second dye units 22, 24. Pump 80 communicates with first dye unit 22 via foam discharge lines 82 and 84 and further with second dye unit 24 via foam discharge lines 86 and 88. Lines 82, 84, 86, 88 join and inlet to pump 80 across vacuum line 90. A foam disposal line 94 is provided at the exit of pump 80.

Figure 2:
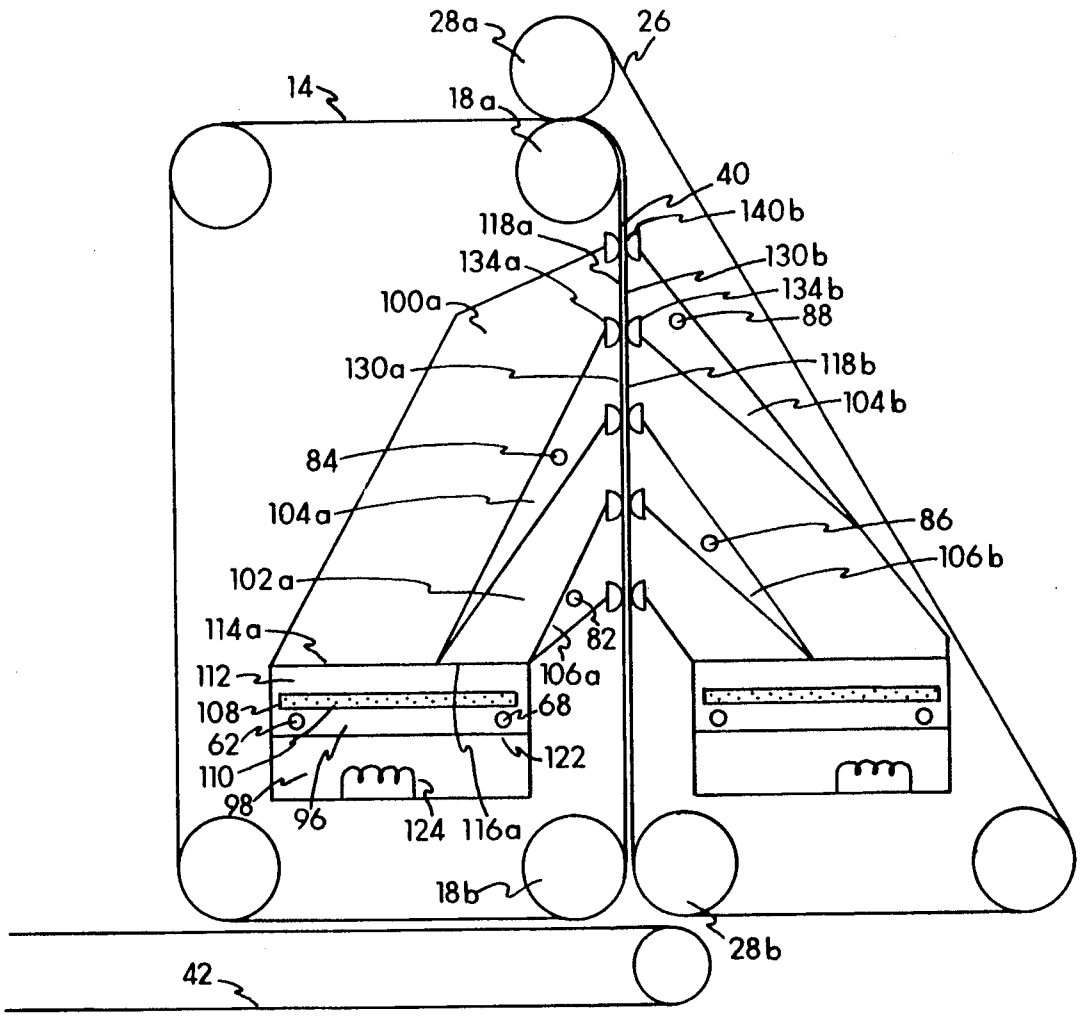
FIG. 2 is a cross-sectional view of the dyeing apparatus as seen along the line—in FIG. 1.

FIG. 2 shows the interior of first and second dye units 22, 24 which will be described in detail with respect to first dye unit 22. First dye unit 22 comprises a foaming pan 96, a heat reservoir 98, a pair of foam transmission chambers 100*a*, 102*a* and a pair of foam discharge Chambers 104*a*, 106*a*. Foaming pan 96 is connected to liquids feed line 62 and liquids withdrawal line 68 to provide fluid communication with tank 50 and pump 60. Disposed Within pan 96 is a gas distributor 108 having a tubular construction and having a plurality of perforations 110 penetrating its wall. Gas distributor 108 is connected to gas distributor line 52 to provide fluid communication with gas pump 48.

Pan 96 has an Open top 112 which is continuous with wide-mouthed inlet ports 114*a* and 116*a* of foam transmission chambers 110*a* and 102*a* respectively. Foam transmission chamber 100*a* extends upward in a tapered manner from inlet port 114*a* to outlet port 118*a* at open interface 40, thereby defining a throttled conduit in fluid communication with pan 96 and open interface 40. Foam transmission chamber 112*a* has a construction substantially similar to chamber 100*a*.

Pan bottom 122 is enclosed and is in conductive heat transfer communication with fully-enclosed heat reservoir 98 positioned therebelow. Heat reservoir 98 is filled with a heat transfer fluid such as oil and has an immersion heater 124 disposed therein.

In vertically stacked alternating sequence with each foam transmission chamber 100*a*, 102*a* are foam discharge chambers 104*a*, 106*a*. Foam discharge chambers 104*a*, 106*a* taper to closed ends adjacent pan 96, but each has an inlet port, as for example inlet port 130*a* of chamber 104*a* which opens into fluid communication with interface 40. Foam discharge chambers 104*a*, 106*a* are connected to foam discharge lines 82 and 84 respectively to provide fluid communication with vacuum pump 80. Partitions are provided in interface 40 between each stacked chamber to prevent fluid communication between adjacent stacked chambers of first dye unit 22, e.g., for example partition 134*a* is shown between chambers 100*a* and 104*a*. Partitions, such as 140*a*, are further provided at the top and bottom of first dye unit 22 to retain fluids within dyeing apparatus 10 and further to guide belts 14 and 26 through open interface 40.

Second dye unit 24 contains substantially identical components as first dye unit 22 except that foam transmission chambers 100*b*, 102*b* and foam discharge chambers 104*b*, 106*b* of second dye unit 24 are arranged opposite foam transmission chambers 100*a*, 102*a* and foam discharge chambers 104*a*, 106*a* of first dye unit 22 in a mirror image thereof. Accordingly, each foam transmission chamber 100*a*, 102*a* of first dye unit 22 is coupled in substantial fluid isolation with a foam discharge chamber 104*b*, 106*b* of second dye unit 24 and each foam discharge chamber 104*a*, 106*a* of first dye unit 22 is coupled in substantial fluid isolation with a foam transmission chamber 100*b*, 102*b* of second dye unit 24. Each outlet port of the foam transmission chambers is sized substantially identical to the coupled inlet port of the opposing foam discharge chamber to align substantially identically therewith. Thus, for example, outlet port 118*a* of foam transmission chamber 100*a* aligns substantially identically with inlet port 130*b* of foam discharge chamber 104*b* with interface 40 therebetween.

First and second dye units 22 and 24 in combination make up four couplings of foam transmission and discharge chambers. Thus, for example, first coupling comprises chambers 100*a* and 104*b*. Each coupling is discretely partitioned in fluid isolation from the remaining couplings at interface 40 by, for example partitions 134*a,b* with respect to couplings 100*a*, 104*b* and 100*b*, 104*b*. Partitioning of couplings results in discrete foam flux planar for each coupling in interface 40.

Figure 3:
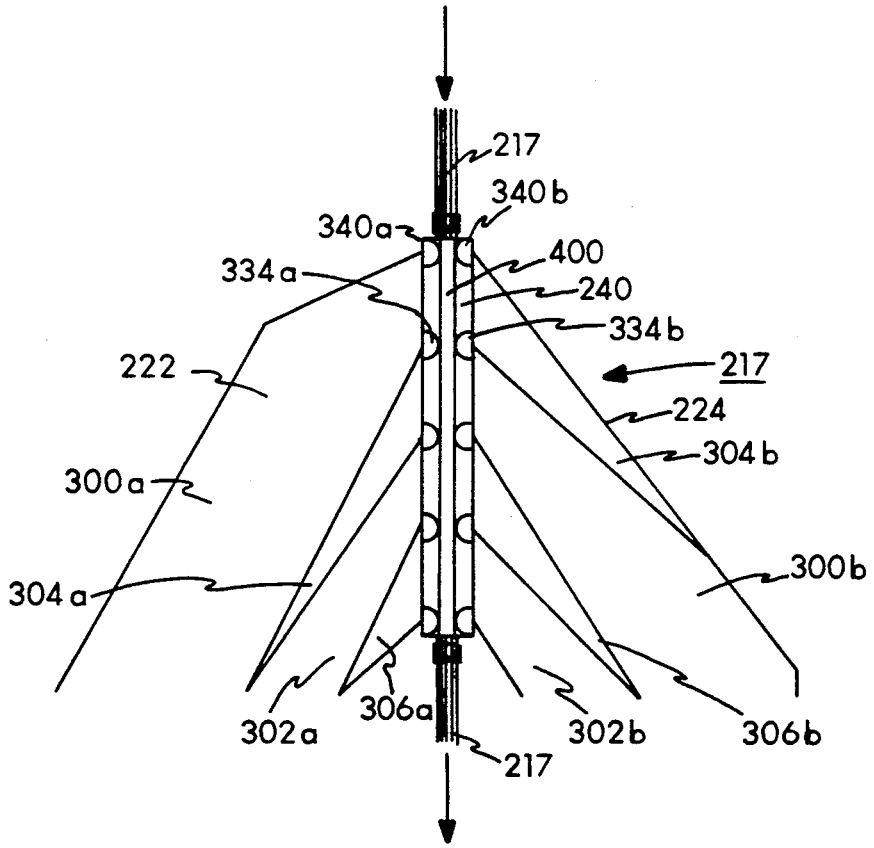
FIG. 3 is a cross-sectional view of an embodiment of the dyeing apparatus for straight yarn.

A second embodiment of the present yarn dyeing apparatus is shown with reference to FIG. 3 and generally designated as 210. Yarn dyeing apparatus 210 differs from first embodiment 10 in that coilers, belts, and belt rollers are omitted. In their place is a yarn guide 400 having a plurality of guide rollers 402, 404 and a rectangular guide frame 406 which provides for the conveyance and dyeing of straight yarn strands exemplified by 216 rather than coiled yarn strands as in apparatus 10. The straight yarn strands are conveyed through apparatus 210 continuously in parallel juxtaposition such that the strands give the appearance of a flat two-sided continuous ribbon 217.

Figure 5:
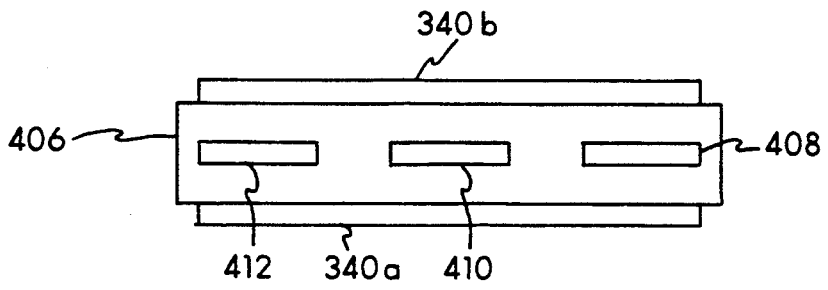
FIG. 5 is a top view of a yarn guide employed in the dyeing apparatus of FIG. 3.
Figure 4:
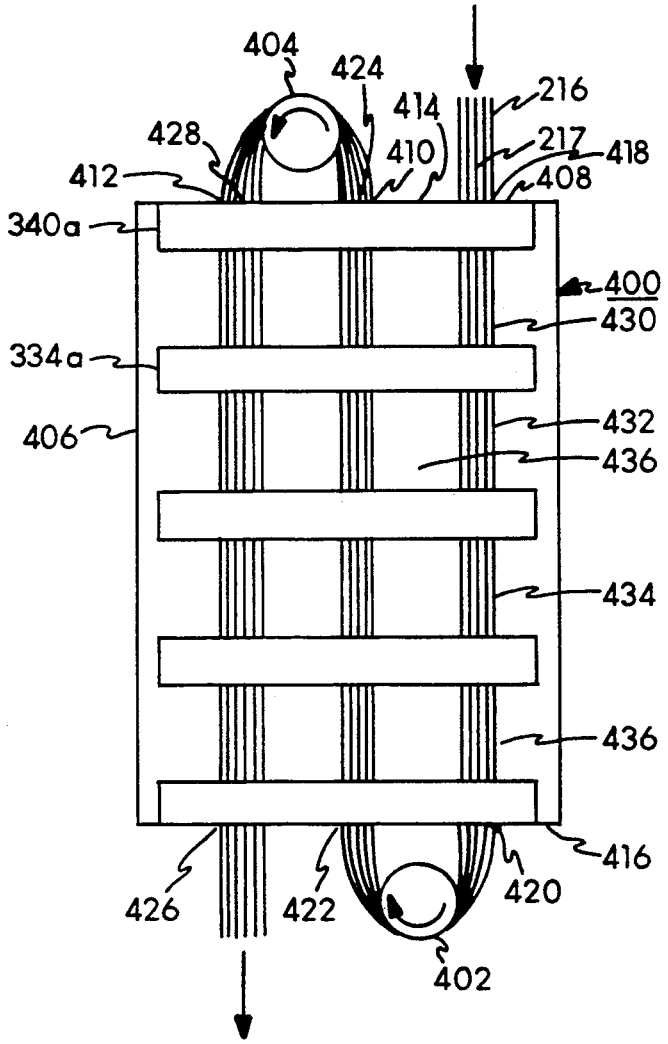
FIG. 4 is a frontal view of a yarn guide employed in the dyeing apparatus of FIG. 3.

Yarn dyeing apparatus 210 has first and second dye units 222 and 224 which are substantially identical to dye units 22, 24 of the first embodiment 10 Frame 406 is positioned in interface 240 between units 222, 224 and has partitions such as 334*a,b*, 340*a,b*, affixed thereto which function in substantially the same manner as those of apparatus 10. Yarn guide 400 is described in greater detail with reference to FIGS. 4 and 5.

Frame 406 Which has three vertical slots 408, 410, 412 formed continuously therethrough from top 414 to bottom 416. Slots 408, 410, 412 provide a continuous up and down pathway for ribbon 217 through interface 240. Accordingly, slot 408 has an inlet 418 in top 414 to receive ribbon 217 from a source (not shown). Outlet 420 of slot 408 is adjacent to bottom guide roller 402 at bottom 416 which feeds ribbon 217 to inlet 422 of slot 410 at bottom 416. Ribbon 217 exits slot 410 at top 414 which is adjacent top guide roller 404. Ribbon 217 is fed by roller 404 back to slot 412 via inlet 426 and finally exit slot 412 and frame 406 via outlet 428.

Guide rollers 402, 404 are freely rotatable. Roller 402 is shown rotating in a clockwise direction and roller 404 is shown rotating in a counterclockwise direction to redirect the yarn strands when they arrive at bottom 416 or top 414 of frame 406 from outlet 424 or outlet 424 respectively. Rollers 402, 404 have an angular orientation of about 45° relative to the axis of frame 406 to twist ribbon 217 and enable redirecting and feeding of ribbon 217 into the inlet of the adjacent slot.

Frame 406 is further provided with rows of windows 430, 432, 434 forming a horizontal continuum therethrough. Windows are aligned with slots 408, 410, 412 respectively to provide fluid communication between the front and back of ribbon 217 in frame 406 and foam transmission chambers 300*a,b*, 302*a,b*. Frame 406 is sized such that its width is slightly less than the width of interface 240 to fit closely between units 222, 224. The area of frame face 436 approximate the cross-sectional area of interface 240.

Method of Operation

The yarn dyeing method of the present invention is now described in terms of operation of apparatus 10 and with reference to FIGS. 1 and 2. For purposes of illustration, the method as described applies to a single yarn strand passing through a single foam transmission chamber/foam discharge chamber coupling, although it is understood that the present method preferably applies to a plurality of yarn strands being dyed continuously in a sequence of couplings as shown and described above.

The method is initiated by feeding straight yarn strand 16 to coiler 12 where strand 16 is loosely coiled and deposited on moving feeder belt 14. Although strand 16 is coiled, substantially its entire surface area remains exposed for dyeing by avoiding balling or bunching of coiled yarn strand 16. Coiling maximizes the length of yarn strand 16 which can occupy a unit length of feeder belt 14 and greatly increases the yarn throughput of apparatus 10.

Belt 14 carries coiled strand 16 to roller intersection 32 where stabilizer belt 26 is pinched against belt 14 by rollers 18*a* and 28*a*. Coiled strand 16 is thereby sandwiched between belts 14 and 26 to hold strand 16 in place as it passes down vertical pathway 36. Belts 14, 26 are porous and preferably are constructed from a synthetic fiber mesh material which does not retain substantial amounts of liquids or dyestuff, such as polyester. The mesh size is selected to correlate to a desired bubble size for the dye foam as described below. 18×24 is an exemplary mesh size although many other mesh sizes are possible.

Concurrent with conveyance of coiled yarn strand 16 through vertical pathway 36, a dye solution comprising a solvent, dyestuff, and surfactant is continuously circulated by pump 60 from tank 50 through foaming pan 96 of first and second dye units 22, 24. The dye solution circulation rate is preferably about 4 to 5 times greater than the total dye solution feed rate to foam transmission chambers 100*a,b*, 102*a,b* Which reduces overall depletion of dyestuff and surfactant from the dye solution in pan 96 as yarn dyeing proceeds and reduces the need to replenish these constituents during the continuous dyeing run. The dye solution in pan 96 is heated by heat conduction from heat reservoir 98 to a dyeing temperature, preferably between about 40° and 100° C., more preferably between about 70° and 90° C., and most preferably to a temperature of about 80° C.

The dyestuff and solvent may be conventional such as aqueous solvents and dyestuffs compatible therewith. Foam is generated in pan 96 by injecting a gas into the dye solution from distributor 108 immersed in the solution to form an emulsion of gas bubbles in the dye solution. Foam characteristics and particularly bubble size are controlled as a function interalia of gas feed rate, dye solution properties and the differential pressure within the foam transmission/foam discharge chamber coupling. The foaming gas is preferably ambient air drawn into distributor 108 by gas pump 48 from the surrounding atmosphere.

The differential pressure is maintained in the coupling by establishing a reference pressure in foam transmission chamber 100*a* and at least partially evacuating corresponding foam discharge chamber 104*b* by means of vacuum pump 80 to reduce the pressure of discharge chamber 104*b* below that of the reference pressure. The reference pressure of foam transmission chamber 100*a* which is measured at inlet port 114*a* is between about ambient atmospheric pressure and 1.5 atm and preferably between about ambient atmospheric pressure and 1.1 atm, while the reduced pressure of foam discharge chamber 104*b* may be as low as full vacuum and is typically about 0 to 0.5 atm. Accordingly, a preferred differential pressure is on the order of about 1 atm.

From the description set forth above, it may be seen that as yarn strand 16 is drawn through vertical pathway 36 between moving belts 14, 26, the foam produced in pan 96 is drawn up through foam transmission chamber 100*a* by the differential pressure in foam discharge chamber 104*b*. Transmission chamber 100*a* is tapered toward outlet port 118*a* which enhances the foam quality by maintaining bubble stability. The foam exits outlet port 118*a* of transmission chamber 100*a* and enters interface 40 which is fluid isolated from adjoining coupling by partition 134*a*, 134*b*. As the foam hits belt 14, it passes therethrough to the extent that the bubbles are smaller than the mesh size. Larger bubbles will collapse on the mesh and reform as smaller bubbles capable of passing through the mesh. In this manner, belt mesh size governs bubble size. It is preferable that a relatively high bubble density of relatively small sized bubbles is maintained along the foam pathway, i.e., on the order of less than about 1 mm, to enhance the stability of the foam and the deposition of the dyestuff on the yarn.

After passing through belt 14, the foam contacts yarn strand 16, and the bubble lamellae collapse upon contact which causes the dyestuff in the dye solution to deposit on the yarn surface. Because the dye solution is preheated to the dyeing temperature, a relatively high percentage of the dyestuff, i.e., between about 50 and 100%, fixes to the yarn on contact without requiring additional processing such as steaming. Thereafter, the differential pressure draws the spent dye solution from interface 40 into discharge chamber 104*b* where it is withdrawn via line 88 for disposal, while the dyed yarn strand 16 is deposited on discharge belt 42 for withdrawal from apparatus 10 and additional downstream processing as desired.

Yarn dyeing apparatus 10 advantageously provides a wide foam flux plane so that many yarn strands can be dyed simultaneously. Yarn dyeing apparatus 10 additionally provides a plurality of chamber couplings in alternating sequence so that several dye applications can be made to the yarn strands alternately on the front and the back thereof. This assures thorough and uniform dyeing of the strands in a single continuous pass through apparatus 10.

Yarn dyeing apparatus 210 operates in substantially the same manner as apparatus 10 except that yarn strands 216 are conveyed through interface 240 in a straight condition and in parallel juxtaposition to appear as a continuous ribbon 217. Ribbon 217 is conveyed through interface 240 by means of yarn guide 400 which, like embodiment 10, assures thorough and uniform dyeing of the strands in a single continuous pass through apparatus 210.

Both embodiments can be modified within the scope of the present invention to enable multi-color dyeing of the yarn. Thus, for example, each foam transmission chamber could be connected to a separate foaming pan having a different colored dye solution therein and the different dyestuffs could be sequentially applied to the yarn. Additionally, the apparatus of the present invention can be modified by the addition of an automated process control system provided by a network of monitoring equipment and a microprocessor responsive to the output of the monitoring equipment. In accordance therewith, pressure and yarn throughput speed have been identified as primary control parameters.

While the particular Continuous Foam Dyeing Apparatus and Method as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

I claim:

1. An apparatus for continuously dyeing yarn with a foam comprising:

a foaming pan;

a gas distributor positioned within said pan;

means in heat transfer communication with said pan for heating a liquid dye solution contained within said pan;

a foam transmission chamber having a foam inlet port in fluid communication with said pan and further having a foam outlet port;

a spent foam discharge chamber in corresponding alignment with said foam transmission chamber to receive spent foam, said foam transmission and discharge chambers forming a coupling, and said spent foam discharge chamber having a foam inlet port positioned opposite said foam outlet port of said foam transmission chamber;

an interface between said inlet port of said spent foam discharge chamber and said outlet port of said foam transmission chamber; and means for conveying at least one continuous strand of yarn through said interface in a direction substantially perpendicular to a foam flow path across said interface.

2. An apparatus for continuously dyeing yarn as recited in claim 1 further comprising means for coiling said at least one continuous strand of yarn and feeding said at least one continuous strand of yarn to said conveying means.

3. An apparatus for continuously dyeing yarn as recited in claim 2 wherein said conveying means comprises a pair of porous moving belts parallelly abuttingly positioned in said interface to maintain said at least one continuous coiled strand of yarn in alignment through said interface.

4. An apparatus for continuously dyeing yarn as recited in claim 3 wherein said porous belt is a screen.

5. An apparatus for continuously dyeing yarn as recited in claim 4 wherein said screen has a mesh size of about 18×24.

6. An apparatus for continuously dyeing yarn as recited in claim 1 wherein said conveying means comprises a frame positioned in said interface and having windows formed therethrough to provide fluid communication between said foam transmission chamber and said spent foam discharge chamber across said frame.

7. An apparatus for continuously dyeing yarn as recited in claim 1 wherein said foam transmission chamber is tapered recited in the direction of said interface.

8. An apparatus for continuously dyeing yarn as recited in claim further comprising means for maintaining the pressure of said spent foam discharge chamber less than the pressure of said foam transmission chamber.

9. An apparatus for continuously dyeing yarn as recited in claim 1 further comprising a plurality of correspondingly aligned foam transmission chamber and spent foam discharge chamber couplings, and a plurality of partitions in said interface to substantially prevent fluid communication between said couplings.

10. An apparatus for continuously dyeing yarn as recited in claim 9 wherein said couplings are stacked in alternating sequence such that each said foam transmission chamber in said sequence is vertically bounded by one of said spent foam discharge chambers.

11. An apparatus for continuously dyeing yarn with a foam comprising:

a foam transmission chamber having a foam inlet port to receive a ye-containing foam and further having a foam outlet port;

a spent foam discharge chamber in corresponding alignment with said foam transmission chamber to receive spent foam, said foam transmission and discharge chambers forming a coupling, and said spent foam discharge chamber having a foam inlet port positioned opposite said foam outlet port of said foam transmission chamber;

an interface between said inlet port of said spent foam discharge chamber and said outlet port of said foam transmission chamber; and a frame positioned in said interface and having windows formed therethrough to provide fluid communication between said foam transmission chamber and said foam discharge chamber across said frame, said frame for conveying at least one continuous strand of yarn through said interface in a direction substantially perpendicular to a foam flow path across said interface.

12. An apparatus for continuously dyeing yarn with a foam comprising:

a foaming means for generating a dye-containing foam;

a foam transmission chamber having a foam inlet port in fluid communication with said foaming means to receive said dye-containing foam and further having a foam outlet port;

a spent foam discharge chamber in corresponding alignment with said foam transmission chamber to receive spent foam, said foam transmission and discharge chambers forming a coupling, and said spent foam discharge chamber having a foam inlet port positioned opposite said foam outlet port of said foam transmission chamber;

an interface between said inlet port of said spent foam discharge chamber and said outlet port of said foam transmission chamber; and a frame positioned in said interface and having windows formed therethrough to provide fluid communication between said foam transmission chamber and said foam discharge chamber across said frame, said frame for conveying at least one continuous strand of yarn through said interface in a direction substantially perpendicular to a foam flow path across said interface.

* * * * *

UNITED STATES PATENT AND TRADEMARK OFFICE

CERTIFICATE OF CORRECTION

PATENT NO. : 5,168,731

DATED : December 8, 1992

INVENTOR(S) : Theodore Vidalis

It is certified that error appears in the above-identified patent and that said Letters Patent is hereby corrected as shown below:

Column 3, line 60: delete "18a, 18a" and insert --18a, 28a--.

Column 3, line 67: after "apparatus", insert --10--.

Column 4, line 44: delete "110a" and insert --100a--.

Column 4, line 49: delete "112a" and insert --102a--.

Column 5, line 34: delete "104a" and insert --104a --.

Column 9, line 18: after "claim", insert --1--.

Signed and Sealed this

Twenty-first Day of December, 1993

*Attest:*

Bruce Lehman

BRUCE LEHMAN

*Attesting Officer*

*Commissioner of Patents and Trademarks*